United States Patent [19]

Henderson, Jr. et al.

[11] Patent Number: 4,591,296

[45] Date of Patent: May 27, 1986

[54] TEMPORARY GUIDE BASE RETRIEVAL METHOD AND APPARATUS

[75] Inventors: Herman O. Henderson, Jr.; Richard L. Coombs, both of Houston, Tex.

[73] Assignee: Smith International, Inc., Newport Beach, Calif.

[21] Appl. No.: 535,306

[22] Filed: Sep. 23, 1983

[51] Int. Cl.[4] ..... E02D 5/74

[52] U.S. Cl. ..... 405/195; 166/339; 166/349; 405/224

[58] Field of Search ..... 405/195, 224; 166/339, 166/340, 341, 342, 349, 365

[56] References Cited

U.S. PATENT DOCUMENTS 3,358,752 12/1967 Postlewaite ..... 166/349 X
4,286,665 9/1981 Walker ..... 166/339
4,387,771 6/1983 Jones ..... 166/341
4,405,263 9/1983 Hall ..... 405/224

*Primary Examiner*—David H. Corbin
*Attorney, Agent, or Firm*—David A. Rose; William E. Shull; David S. Wise

[57] ABSTRACT

The invention disclosed herein includes a method and apparatus for latching a temporary guide base to a permanent guide base as the permanent guide base is raised, whereby the two guide bases may be retrieved simultaneously. The apparatus includes a socket means in each guideline of the temporary guide base and a latch means in the base of each guidepost of the temporary guide base. When the permanent guide base is lowered, the latch means passes over the socket means. When the permanent guide base is raised, however, the latch means engages the socket means and the temporary guide base is raised.

15 Claims, 4 Drawing Figures

26
56
44
60
12
46
58
40
42
50
52
57
54
64
62
10
34
16
20
18
30
22
38
36
62
32
16
16
24
14
24

TEMPORARY GUIDE BASE RETRIEVAL METHOD AND APPARATUS

BACKGROUND OF THE INVENTION

The present invention relates to apparatus for drilling an undersea borehole and, more particularly, to guide base apparatus forming a foundation on the ocean floor for drilling activity. Still more particularly, the present invention relates to a method and apparatus for recovering all such guide base apparatus in a single trip from the ocean floor to an offshore drilling platform.

The development of oil producing capability in offshore oil fields often includes, at preliminary stages, the drilling of multiple boreholes which are not intended to support producing wells. Such boreholes might be drilled, for example, for exploration of geological formations thought to contain hydrocarbon fluids or for appraisal of known hydrocarbon-containing formations to determine the optimum positions for producing wells.

Drilling an exploratory or appraisal well begins with lowering a temporary guide base from the offshore drilling platform floating at the ocean surface down to the ocean floor. The temporary guide base is a foundation structure which includes a central opening and four guidelines which extend from the offshore platform to positions equally spaced about the guide base. A utility guide frame is attached to the guidelines at the platform and used to lower drilling tools down to the temporary guide base and through the central opening therein to the ocean floor. Using the drilling tools and seawater, a pilot hole is drilled through the temporary guide base to a depth of 100 to 600 feet. Return fluid with drilled cuttings is spilled onto the temporary guide base and surrounding ocean floor.

After the pilot hole has been drilled, a string of thirty inch casing, sometimes called a foundation pile, is lowered through the temporary guide base into the pilot hole and is cemented into place. The upper end of the foundation pile includes a conductor housing assembly which supports the foundation pile from the temporary guide base and provides a landing base for additional strings of casing. A permanent guide base is secured around the conductor housing assembly and is lowered simultaneously with the foundation pile.

The permanent guide base comprises a foundation structure of approximately the same dimensions as the temporary guide base and includes a central opening for receiving the conductor housing assembly. The permanent guide base further includes four guideposts extending upwardly from the structure for receiving the four guidelines extending from the temporary guide base. Once the guidelines have been inserted into slots in the guideposts at the platform, the permanent guide base with attached foundation pile is lowered on a string of pipe into position atop the temporary guide base on the ocean floor. The two guide bases include cooperative structure, sometimes referred to as a gimbal structure, for maintaining the permanent guide base level in a horizontal plane despite as much as a twelve degree deviation from the horizontal in the position of the temporary guide base due to a sloping ocean floor.

Once the permanent guide base and foundation pile are set in place and cemented, additional drilling and casing occurs, a wellhead and a subsea blowout preventer stack are installed, and deeper drilling begins in earnest. The permanent and temporary guide bases provide primary guidance and support for these activities.

When all drilling activity has been completed and the usefulness of the drilled borehole is expended, clean-up of the drilling site begins. In many parts of the world, for example, in the North Sea off the coast of Norway, the ocean floor in the area of the drilling site must be cleared of all drilling apparatus. Thus, casing is cut from within the borehole and tripped back to the platform at the ocean surface. The foundation pile is severed with explosives and tripped to the platform along with the permanent guide base. Finally, the temporary guide base is retrieved using a running tool on a string of drill pipe.

Often, however, there is some difficulty in retrieving the temporary guide base. Depending on soil conditions at the ocean floor, the temporary guide base may have become substantially buried. Cuttings dumped onto the guide base during initial drilling operations may contribute to the problem. The guide base is normally retrieved with the aforementioned running tool by engaging J-shaped slots within an inner sleeve in the central opening of the guide base. When the temporary guide base is even partially buried, however, the process of engaging the J-slots with the running tool can prove to be quite difficult and time-consuming. The problem is compounded if the temporary guide base rests on an incline.

The difficulties associated with the conventional method for retrieval of the temporary guide base gave rise to an outcry among companies engaged in offshore drilling for a more efficient method of retrieval. Initial attempts at solving the problem have focused on a hook apparatus for securing the temporary guide base to the permanent guide base when the latter is lowered onto the former. Thus, when the permanent guide base and foundation pile are tripped to the surface, the temporary guide base is simultaneously retrieved.

Generally, such hook apparatus have been successful in achieving simultaneous retrieval of the temporary guide base. However, such hook apparatus tend to limit movement of the permanent guide base relative to the temporary guide base, thus restricting the operation of the gimbal structure and, in some cases, preventing the permanent guide base from assuming a horizontal position atop an inclined temporary guide base.

Hence, it appears that a need exists for a simple and efficient means for retrieving the temporary guide base. It further appears that the known prior art does not provide suitable means for addressing this need.

SUMMARY OF THE INVENTION

Accordingly, there is provided herein a method and apparatus for simply and effectively retrieving simultaneously a temporary guide base and a permanent guide base. A socket means is included in each guideline which connects the temporary guide base to the ocean surface. A latch means is included in each guidepost of the permanent guide base. As the permanent guide base is lowered to the ocean floor, the latch means within each guidepost passes unimpeded over the socket means in each guideline. When the permanent guide base is raised, however, the latch means in each guidepost engages the socket means in each guideline and thereafter the temporary guide base is raised also. The apparatus of the present invention is simpler in operation than the known prior art apparatus and does not interfere with the ability of the permanent guide base to gimbal relative to the temporary guide base.

The socket means may comprise a spelter socket connected to the guideline and a retrieval cable connecting the spelter socket to the temporary guide base. The spelter socket includes a nose cone connected to the guideline, a cable connector connected to the retrieval cable, and a shear pin member connecting the nose cone to the cable connector.

The shear pin member and the nose cone define a generally conical upper end of the spelter socket. Below the conical upper end, the shear pin member further defines a downwardly facing annular surface. A brass shear pin preserves the connection between the shear pin member and the cable connector.

The latch means may comprise a split ring expandably disposed within a ring housing. The ring housing includes an upper support ring welded within the lower end of the guidepost as well as a clamping ring and lower support ring removably secured to the upper support ring. The clamping ring and the lower support ring cooperatively define a structure for supporting the split ring.

The split ring may comprise a discontinuous ring having a generally horizontal upper surface, a tapered inner surface having the least inner diameter at the upper surface, and a plurality of radial slots open to the interior of the split ring.

In operation, as the permanent guide base is lowered onto the temporary guide base, the tapered surface of the split ring contacts the conical upper end of the socket means, causing the split ring to expand and pass substantially unimpeded over the outside of the socket means. When the permanent guide base is raised, however, the horizontal upper surface of the split ring contacts the downwardly facing annular surface of the socket means, causing the latch means to engage the socket means and thereby lift the temporary guide base.

Thus, the present invention provides a method and apparatus for retrieving simultaneously the temporary guide base and the permanent guide base. By comparison with known prior art apparatus, the present invention is simpler and equally or more effective. In contrast to the known prior art, however, the present invention does not require an interlock between the temporary and permanent guide bases until after retrieval of the permanent guide base has begun. Hence, the ability of the permanent guide base to gimbal is unaffected by the present invention.

These and various other characteristics and advantages of the present invention will become readily apparent to those skilled in the art upon reading the following detailed description and referring to the accompanying drawings.

BRIEF DESCRIPTION OF THE DRAWINGS

For a detailed description of the preferred embodiment of the invention, reference will now be made to the accompanying drawings, wherein.

DESCRIPTION OF THE PREFERRED EMBODIMENT

The first piece of equipment lowered to the ocean floor in anticipation of drilling a borehole therein is a temporary guide base. The temporary guide base provides a foundation for further undersea equipment and tools and remains connected to an offshore drilling platform at the surface of the ocean via guidelines formed of steel cable. Because the temporary guide base is beneath any other equipment subsequently lowered to the ocean floor, it often sinks into the soil and becomes at least partially buried. In such a case, recovery of the temporary guide base, as where the borehole was drilled for exploratory or appraisal purposes and the undersea well site must be scoured of all apparatus, can become very difficult.

In accordance with the principles of the invention, apparatus is included with the temporary guide base and a permanent guide base whereby retrieval of the permanent guide base causes simultaneous retrieval of the temporary guide base. The present invention comprises a latch apparatus in the base of each guidepost on the permanent guide base and a specially adapted spelter socket in each of the guidelines extending from the temporary guide base to the surface platform. As the permanent guide base is lowered onto the temporary guide base, the latch apparatus within each guidepost passes unimpeded across the spelter socket in each guideline. As the permanent guide base is raised, however, the latch apparatus engages the spelter socket so as to lift the temporary guide base with the permanent guide base.

Figure 1:
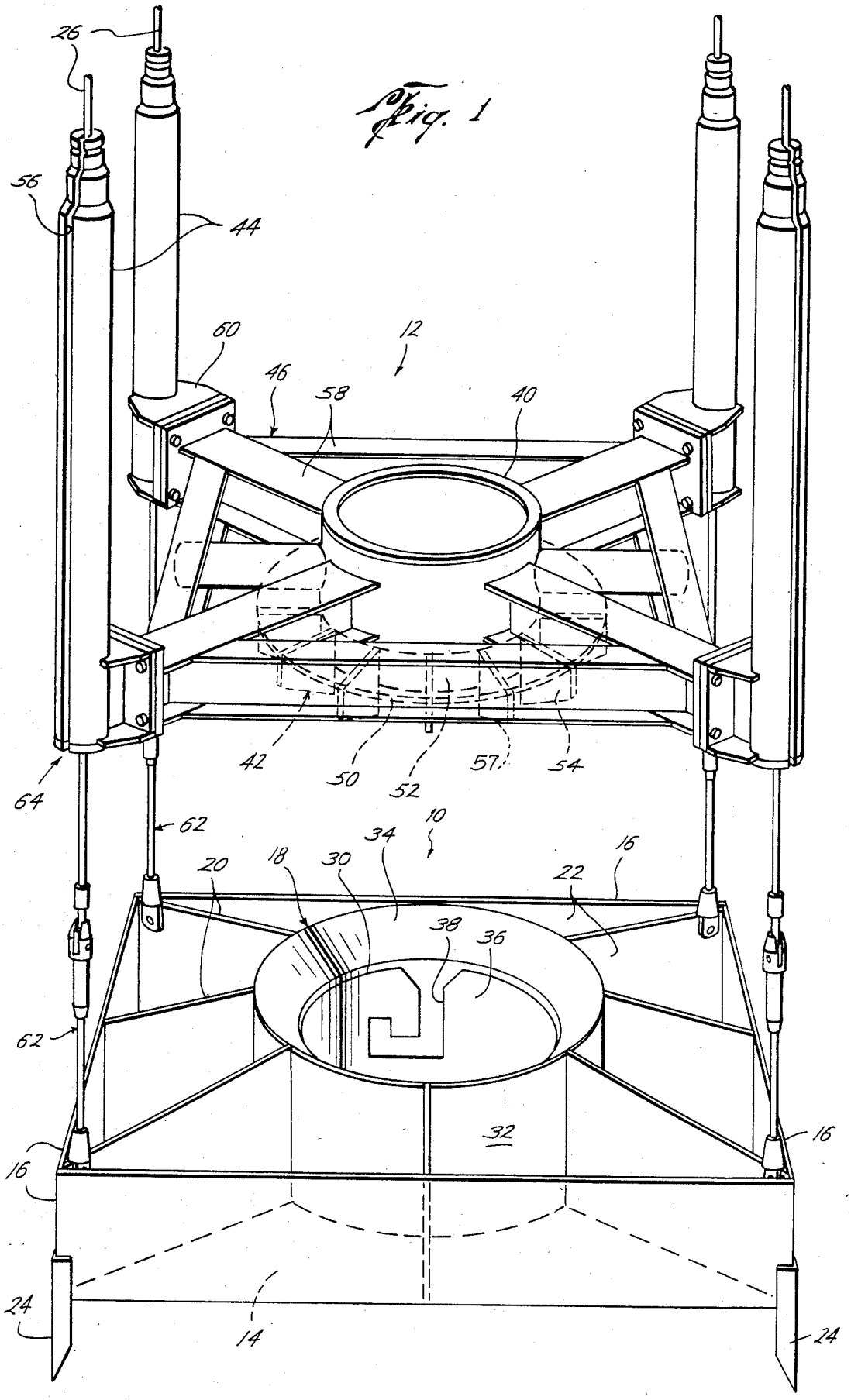
FIG. 1 shows a perspective view of a temporary guide base and a permanent guide base arranged according to the principles of the present invention.

More particularly, there is shown in FIG. 1 a perspective view of a temporary guide base 10 and a permanent guide base 12 structured in accordance with the principles of the invention. The temporary guide base 10 comprises a generally square, planar structure fabricated from steel, including a bottom plate 14, four outer sidewalls 16, a landing ring 18, and a plurality of inner sidewalls 20. The temporary guide base 10 further includes at each corner thereof an anchor spike 24 for extension approximately eighteen inches into the subsea soil and a guideline 26 extending upwardly to the offshore platform (not shown).

The landing ring 18 comprises a pair of concentrically disposed cylinders 30, 32 extending upwardly from a circular hole in the center of the generally square bottom plate 14. The outer cylinder 32 extends beyond the upper end of the inner cylinder 30, whereby an inverted frusto-conical ring 34 may be affixed between the upper ends of the cylinders 30, 32 to form a landing surface. The inner cylinder 30 includes an inner sleeve 36 having a plurality of J-shaped grooves 38 formed therein.

The outer sidewalls 16 of the temporary guide base 12 extend upwardly from around the perimeter of the square bottom plate 14 and typically are approximately 7.2 feet in length, whereby the guidelines 26 extending from each corner thereof are positioned on a six foot radius relative to the axial centerline of the landing ring 18. The inner sidewalls 20, of which there may be, for example, eight, extend upwardly from the bottom plate 14 between the landing ring 18 and the outer sidewalls 16 to define a plurality of compartments 22. Typically, the compartments 22 are filled with cement or sacked barite so as to add weight to the guide base 10 for initial drilling activities. The guidelines 26 are attached via sockets 28 to the four corners of the temporary guide base 10.

Referring still to FIG. 1, the permanent guide base 12 is attached to the upper end of a length of a string of casing (not shown) and is lowered to the temporary guide base 10 on a string of drill pipe (not shown). The casing string is received through the landing ring 18 for extension into a borehole drilled therebeneath.

The permanent guide base 12 is a steel structure including a center ring 40, a landing base 42, a plurality of guideposts 44, and a support structure 46. The center ring 40 comprises a cylinder axially aligned with and having approximately the same diameter as the inner ring 30 of the temporary guide base 10. The landing base 42 cooperates with the landing ring 18 of the temporary guide base 10 to define a gimbal structure which permits the permanent guide base 12 to seat in a horizontal plane despite an inclination in the temporary guide base 10. Thus, the landing base 42 includes a horizontal ring 50, a cylindrical element 52, and a plurality of angled landing members 54.

The cylindrical element 52 extends downwardly from the opening in the center of the horizontal ring 50. The landing members 54 are attached in a vertical position about the periphery of the cylindrical element 52 and the lower side of the horizontal ring 50, whereby the angled edge 57 of the landing members 54 will contact the frusto-conical ring 34 of the temporary guide base 10 to define the gimbal structure. The landing base 42 is secured to the lower end of the center ring 40 with the cylindrical element 52 axially aligned with the center ring 40.

Referring still to FIG. 1, the guideposts 44 comprise elongated cylinders normally about eight inches in diameter and ten to twenty feet in height, depending on the height and arrangement of the subsea blowout-preventer stack (not shown). The guideposts 44 include a vertical slot 56 whereby the guidelines 26 may be inserted within the guideposts 44 at the surface platform (not shown).

The support structure 46 secures the guideposts 44 into proper position about the center ring 40. The support structure 45 comprises a plurality of I-beams 58 in crossing and square formations attached to guidepost supports 60, which secure the guideposts 44.

In accordance with the principles of the invention, the temporary and permanent guide bases 10, 12 include means for retrieving the temporary guide base 10 at the same time the permanent guide base 12 is tripped to the surface platform. Referring still to FIG. 1, such retrieval means includes a socket apparatus 62 included in line with each guideline 26 extending from the temporary guide base 10 and a latch apparatus 64 included in the lower end of each guidepost 44 of the permanent guide base 12.

Figure 2:
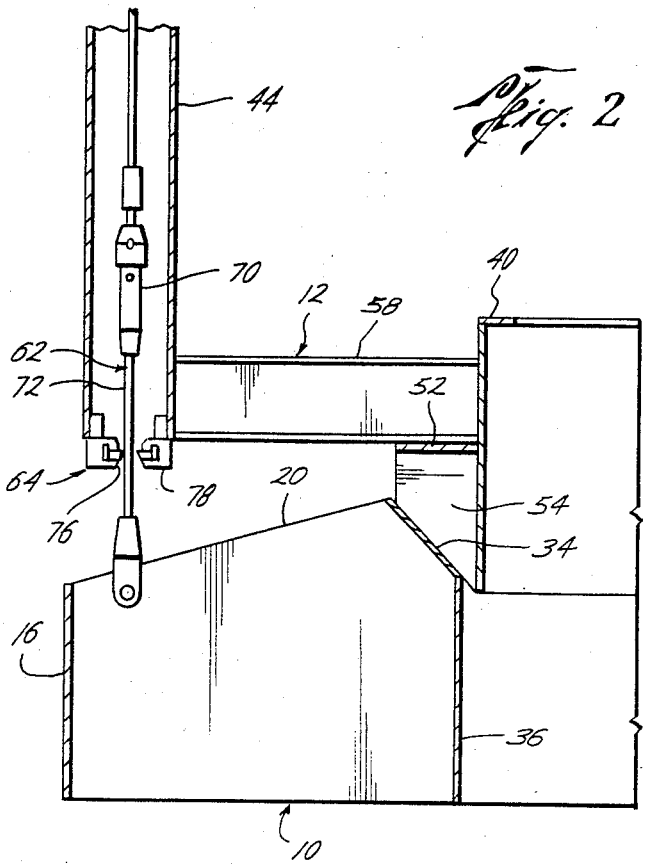
FIG. 2 shows a portion of the temporary and permanent guide bases in cross section so as to reveal the present invention.

Referring now to FIG. 2, a portion of the permanent guide base 12 is depicted on top of the temporary guide base 10. The guide bases 10, 12 are shown in cross section so as to reveal one socket apparatus 62 and one latch apparatus 64. The socket apparatus 62 comprises a spelter socket 70 and a length of retrieval cable 72. The retrieval cable 72 may be, for example, $\frac{7}{8}$-inch diameter steel cable. The spelter socket 70 provides a secure connection between the guideline 26, which is typically $\frac{3}{4}$-inch steel cable, and the retrieval cable 72.

The latch apparatus 64 includes a ring housing 78 affixed within the lower end of the guidepost 44 and a split ring 76 contained within the ring housing 78. The ring housing 78 has an inner diameter which exceeds the maximum outer diameter of the spelter socket 70; the split ring 76 has an inner diameter slightly less than the maximum outer diameter of the spelter socket 70.

As the permanent guide base 12 is lowered onto the temporary guide base 10, the split ring 76 within the latch apparatus 62 expands in diameter to permit passage of the spelter socket 70 therethrough. Once the spelter socket 70 has passed through, the split ring 76 contracts to its original position due to the natural bias of the 4140 alloy steel material from which it is made. After the spelter socket 70 has passed into the guidepost 44, the permanent guide base 12 may be seated atop the temporary guide base 10, as depicted in FIG. 2.

When the permanent guide base is raised off of the temporary guide base 10, the split ring 76 of the latch apparatus 64 engages the spelter socket 70 and transfers the upward force exerted on the permanent guide base 12 through the retrieval cable 72 to the temporary guide base 10. Thus, the temporary guide base 10 is latched to the permanent guide base 12 without any effect on the ability of the permanent guide base to gimbal relative to the temporary guide base.

Figure 3:
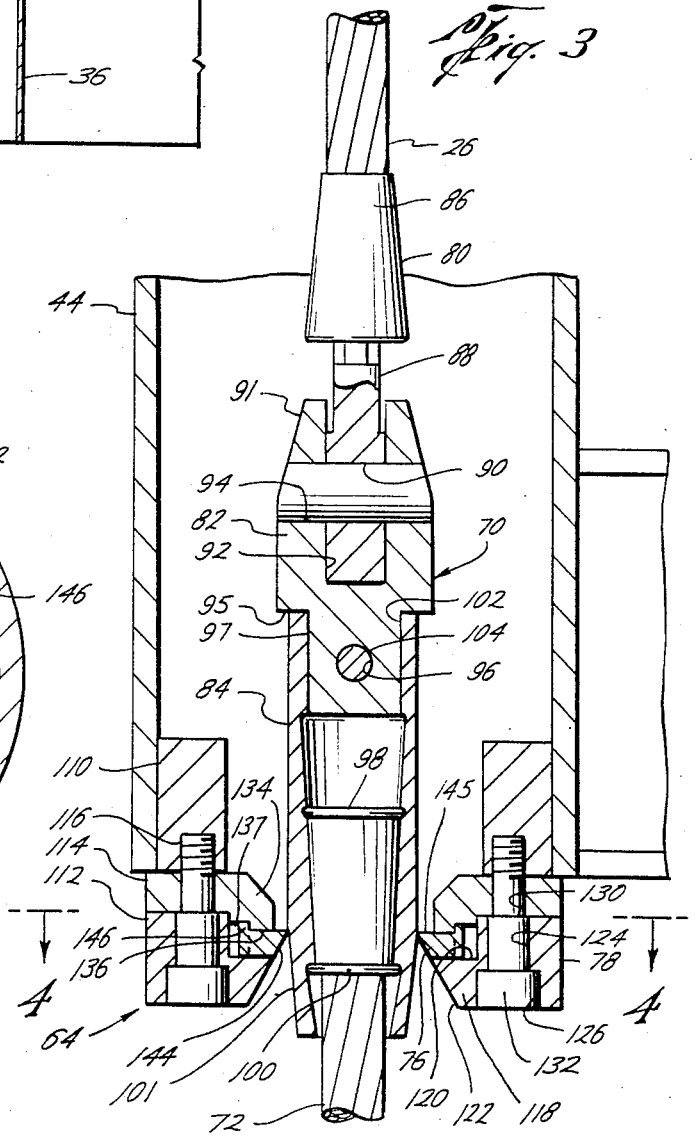
FIG. 3 shows an enlarged, cross-sectional view of the invention.

Referring now to FIG. 3, the spelter socket 70 and the latch apparatus 64 are shown in cross section with the lower portion of the spelter socket 70 within the latch apparatus 76. The spelter socket 70 includes a nose cone 80, a shear pin member 82, and a cable connector 84. The nose cone 80 includes a conical shaped upper end 86, into which the guideline 26 is babbitted, and a lower extension 88 including a cylindrical bore 90. Babbitting is a standard procedure whereby the end of the guideline is frayed and inserted into the hollow upper end 86 of the nose cone 80. Molten alloy comprised of zinc or lead and zinc is then poured into the nose cone and allowed to cool. The guideline is thereby secured within the spelter socket 70.

The shear pin member 82, which connects the nose cone 80 to the cable connector 84, includes a frusto-conical upper end 91 having a radial bore 94 and an axial bore 92 for receiving therewithin the lower extension 88 of the nose cone 80. The nose cone extension 88 is retained within the member 82 by means of a steel pin (not shown) extending through the radial bore 94 in the member 82 and through the cylindrical bore 90 in the nose cone 80. The lower end of the shear pin member 82 includes a downwardly facing, horizontal, annular surface 95 and a cylindrical lower extension 97 projecting downwardly from the annular surface 95. The lower extension 97 includes a radial bore 96 extending therethrough.

The cable connector 84 secures the retrieval cable 72 to the spelter socket 70. The retrieval cable 70 is babbitted, as described above, into the lower portion of the cable connector 84. A pair of steel pins 98, 100 extend through the babbitted portion of the retrieval cable 72 and into the sidewall of the cable connector 84 so as to improve the strength of the connection. The lower end 101 of the cable connector gradually decreases in outer diameter to define an inverted frusto-conical shape. The upper end of the cable connector 84 includes an axial bore 102 for receiving the lower end of the shear pin member 82 and a radial bore (not shown) for alignment with the radial bore 96 in the shear pin member 82 for receipt of a brass shear pin 104 therethrough.

The brass shear pin 104 provides a safety mechanism whereby the load on the platform hoist which is used to raise apparatus from the ocean floor is maintained within acceptable limits. The shear pin 104 is preferably designed to break when the load thereon exceeds approximately 175,000 pounds. Such a load might be experienced, for example, where the temporary guide base has become buried in the ocean floor and a suction is created between the guide base and the soil beneath as the guide base is lifted. When the pin 104 shears, the temporary guide base is released from the four guidelines and the permanent guide base is tripped to the surface platform. Thereafter, the temporary guide base must be fished from the ocean floor by use of a J-slot running tool on a string of drill pipe.

Figure 4:
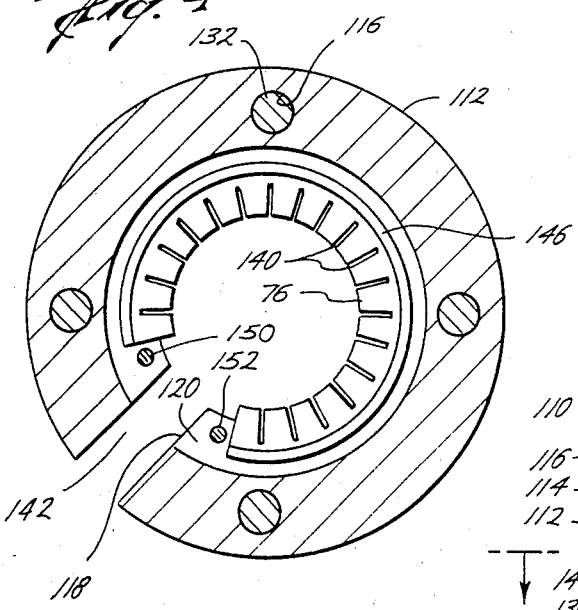
FIG. 4 shows a cross-sectional view taken along a line 4—4 in FIG. 3.

Referring now to FIGS. 3 and 4, there is shown in cross section the latch apparatus 64, including the split ring 76 and the ring housing 78. The ring housing 78 includes three separate rings: an upper support ring 110; a lower support ring 112; and a clamping ring 114. The upper support ring 110 has a generally rectangular cross section and includes four axially extending, threaded boreholes 116 spaced at intervals around the ring 110. The outer diameter of the upper support ring 110 conforms closely to the inner diameter of the guidepost 44 at its lower end, whereby the support ring 110 may be received within and welded to the guidepost 44.

The lower support ring 112 is of approximately the same basic dimensions as the upper support ring 110, except that the lower ring 112 includes an inwardly projecting ledge 118 about the inner circumference of the lower end of the ring 112. The ledge 118 includes a generally horizontal upper surface 120 for support of the split ring 76 and a tapered inner surface 122 increasing in inner diameter from the upper end to the lower end of the ledge 118. The tapered surface 122 guides the conical nose cone 80 of the spelter socket 70 into the latch apparatus 64. The lower support ring 112 further includes four axially extending boreholes 124, which may be aligned with the threaded boreholes 116 in the upper support ring 110, and four counterbores 126 on the axial boreholes 124.

The clamping ring 114 is secured between the upper and lower support rings 110, 112 and includes means for retaining the split ring 76 on the ledge 118 of the lower support ring 112. The clamping ring 114 includes four boreholes 130 which may be aligned with the boreholes 116, 124 in the upper and lower support rings 110, 112. Bolts 132 are received through the boreholes 130, 124 in the clamping ring 114 and the lower support ring 112 and are threaded into the threaded boreholes 116 in the upper support ring. Thus, once the temporary guide base has been hoisted to the surface platform, the latch apparatus 64 may be disassembled by removing the four bolts 132, permitting easy removal of the spelter socket 70 from the guidepost 44.

The clamping ring 114 further includes an inwardly projecting flange 134, projecting from the inner edge of which is a downwardly extending lip 136. The flange 134 and lip 136 define a mechanism for retaining the split ring 76 within a predetermined area 137 on the horizontal surface 120 of the ledge 118.

Referring still to FIGS. 3 and 4, the split ring 76 comprises a ring having a plurality of spaced, radially extending slots 140 open to the interior of the ring 76 and extending toward the periphery of the ring 76. As shown particularly in FIG. 4, the split ring 76 and the lower support ring 112 include a discontinuity 142 corresponding to the slot 56 (FIG. 1) in the guideposts 44, so as to permit insertion of the guidelines 26. Although not shown, the upper support ring 110 and the clamping ring 114 are constructed with a corresponding discontinuity 142.

The inwardly facing surface 144 of the split ring 76 is tapered, with the inner diameter increasing from the upper to the lower surfaces thereof. The upper surface 145 of the split ring 76 is generally horizontal. An upward extension 146 projects from the periphery of the upper surface 145 to a point exteriorly of the downwardly extending lip 136 on the clamping ring 114. A pair of steel pins 150, 152 are received within corresponding bores in the lower support ring 112 so as to prevent rotation of the split ring 76 within the space between the clamping and lower support rings 114, 112.

In operation, as the permanent guide base is lowered onto the temporary guide base, the latch apparatus 64 in the base of each guidepost 44 is lowered onto the spelter socket 70 connected to each guideline 26. The conical nose cone 80 of the spelter socket 70 follows the tapered surfaces 122, 144 of the lower support ring 112 and the split ring 76 and passes through the latch apparatus 64.

As the frusto-conical upper end 91 of the shear pin member 82 contacts the split ring 76, the downward motion of the permanent guide base is translated by the contact between two tapered surfaces to outward expansion of the split ring 76. Such outward expansion is facilitated by the discontinuity 142 and the radial slots 140 in the split ring 76. Thus, the split ring 76 expands to conform to the outer diameter of the spelter socket 70 as the latch apparatus 64 is lowered over the socket 70. Once the spelter socket 70 has passed through the latch apparatus 64, the split ring 76 snaps back into its original configuration. The permanent guide base may then come to rest on the temporary guide base. In contrast to the effect of known prior art apparatus, the ability of the permanent guide base to gimbal relative to the temporary guide base is uninhibited by the present invention.

When the permanent guide base is raised from the temporary guide base, the split ring 76 passes over the inverted frustoconical lower end 101 of the cable connector 84 until the upper surface 145 of the split ring 76 engages the annular surface 95 on the shear pin member 82. Contact between these two generally horizontal surfaces results in no expansion of the split ring 76. Thus, upward motion of the permanent guide base is translated through the latch apparatus 64 to the spelter socket 70 and the retrieval cable 72 and then to the temporary guide base.

If the additional load posed by the temporary guide base exceeds approximately 175,000 pounds, the brass shear pin 104 will break, causing the spelter socket 70 to separate between the shear pin member 82 and the cable connector 84. Thereafter, the temporary guide base will be retrieved by use of the J-slot running tool (not shown) lowered on a string of drill pipe.

The present invention provides an efficient and effective means for retrieving the temporary guide base at the same time that the permanent guide base is tripped to the surface platform. By using a latch apparatus within each guidepost to engage a spelter socket within each guideline, it is unnecessary to physically interlock the structures of the temporary and permanent guide bases. Hence, the guide bases may be retrieved simultaneously without sacrificing the ability of the permanent guide base to gimbal.

While a preferred embodiment of the invention has been shown and described, modifications thereof can be made by one skilled in the art without departing from the spirit of the invention. For example, based on the foregoing disclosure, it would be obvious to one skilled in the art that the apparatus forming a part of the guidelines and the guideposts could be interchanged functionally without varying from the principles of the present invention. More particularly, the lower end of the guidepost could be fitted with a ring member having an upper surface which is substantially horizontal and a lower surface which slopes upwardly toward the center of the ring. The guideline could include a spelter socket having one or more contractable elements protruding radially therefrom. The contractable elements would include a lower surface which is substantially horizontal and an upper surface which slopes downwardly away from the center of the socket. Thus, when the guidepost is lowered over the spelter socket, the contractable elements deform inwardly to allow the socket to pass through the guidepost. When the guidepost is raised, however, the two generally horizontal surfaces engage and the temporary guide base is raised.

What is claimed is:

1. In subsea drilling operations involving a temporary guide base having a plurality of guidelines for extension to the ocean surface and a permanent guide base having a plurality of guideposts for receiving therethrough the guidelines of the temporary guide base, retrieval apparatus comprising:

socket means forming a part of the guidelines of the temporary guide base; and means forming a part of the guideposts of the permanent guide base for engaging said socket means when the permanent guide base is raised.

2. Apparatus according to claim 1, wherein said socket means comprises:

a spelter socket connected to the guideline; and a retrieval cable connecting said spelter socket to the temporary guide base.

3. Apparatus according to claim 2, wherein said spelter socket includes:

a generally conical-shaped upper end; and a downward facing annular surface subadjacent to said conical upper end.

4. Apparatus according to claim 3, wherein said engaging means comprises:

a housing attached to the guidepost; and a latch ring expandably disposed in said housing for engaging said annular surface of said spelter socket.

5. Apparatus according to claim 4, wherein said latch ring comprises:

an upwardly facing annular surface for engaging said downwardly facing annular surface of said spelter socket; and a tapered, inwardly facing surface with least inner diameter at said upwardly facing surface, whereby said engaging means moves downward over said socket means substantially unimpeded and engages said socket means when moving upward.

6. Apparatus according to claim 1, further comprising:

means for releasing the temporary guide base from the permanent guide base in the event that the additional load of the temporary guide base exceeds a predetermined level.

7. Apparatus according to claim 2, wherein said spelter socket comprises:

a nose cone connected to the guideline;

a cable connector connected to said retrieval cable; and a connecting member connecting said nose cone to said cable connector, said connecting member defining a downwardly facing annular surface.

8. Apparatus according to claim 7, wherein said nose cone and said connecting member define a generally conical upper end of said spelter socket above the annular surface of said connecting member.

9. Apparatus according to claim 8, wherein said engaging means comprises:

a ring housing secured to the guidepost of the permanent guide base; and a split ring expandably disposed within said ring housing.

10. Apparatus according to claim 9, wherein said ring housing comprises:

an upper support ring welded in the lower end of the guidepost;

a lower support ring supported from said upper support ring; and a clamping ring supported between said upper and lower support rings, said clamping ring and said lower support ring cooperatively supporting said split ring.

11. Apparatus according to claim 10, wherein said split ring comprises:

a substantially horizontal upper surface;

a tapered inner surface with inner diameter least at said upper surface;

a plurality of radial slots open to the interior of said split ring; and a discontinuity in said split ring, whereby the conical upper end of said spelter socket in contact with said tapered inner surface of said split ring causes gradual expansion of said split ring to accommodate the outer diameter of said spelter socket as the permanent guide base is lowered onto the temporary guide base, and whereby said horizontal upper surface of said split ring engages the annular surface of said spelter socket so as to retrieve the temporary guide base when the permanent guide base is raised.

12. Apparatus according to claim 11, wherein said connecting member of said ring housing is connected to said cable connector by means of a pin designed to shear on application of a predetermined load.

13. Subsea retrieval apparatus, comprising:

a temporary guide base, including a plurality of guidelines for extension from said temporary guide base to a point at or near the ocean surface;

a permanent guide base, including a plurality of guideposts for receiving therethrough the guidelines of said temporary guide base;

socket means forming a part of the guidelines of said temporary guide base; and means forming a part of the guideposts of said permanent guide base for engaging said socket means when said permanent guide base is raised, whereby said temporary guide base may be retrieved at the same time said permanent guide base is retrieved.

14. In subsea drilling operations, a method for simultaneously retrieving a temporary guide base having a plurality of guidelines extending to the ocean surface and a permanent guide base having a plurality of guideposts, comprising the steps of:

providing a socket means in the guidelines of the temporary guide base;

providing a latch means in the guideposts of the permanent guide base;

hoisting the permanent guide base off of the temporary guide base and upward;

securing the socket means to the latch means as the permanent guide base is raised; and hoisting both the permanent and the temporary guide bases to the ocean surface.

15. Method according to claim 14 further comprising the initial steps of:

lowering the temporary guide base to the ocean floor;

placing the guidelines within the guideposts of the permanent guide base and lowering the permanent guide base;

passing the latch means in the guideposts over the socket means in the guidelines substantially unimpeded as the permanent guide base is lowered; and positioning the permanent guide base atop the temporary guide base on the ocean floor.

* * * * *

UNITED STATES PATENT AND TRADEMARK OFFICE

CERTIFICATE OF CORRECTION

PATENT NO. : 4,591,296

DATED : MAY 27, 1986

INVENTOR(S) : HERMAN O. HENDERSON, JR., and RICHARD L. COOMBS

It is certified that error appears in the above—identified patent and that said Letters Patent is hereby corrected as shown below:

In column 5, line 46, after the word "structure" change "45" to -- 46 --.

Signed and Sealed this

*Second* Day of *September 1986*

[SEAL]

*Attest:*

DONALD J. QUIGG

*Attesting Officer*

*Commissioner of Patents and Trademarks*